United States Patent [19]

Taylor et al.

[11] Patent Number: 4,850,197

[45] Date of Patent: Jul. 25, 1989

[54] METHOD AND APPARATUS FOR OPERATING A REFRIGERATION SYSTEM

[75] Inventors: David H. Taylor, Bloomington, Minn.; Lars I. Sjöholm, Sollentuna, Sweden

[73] Assignee: Thermo King Corporation, Minneapolis, Minn.

[21] Appl. No.: 260,831

[22] Filed: Oct. 21, 1988

[51] Int. Cl.[4] ..... F25B 41/00

[52] U.S. Cl. ..... 62/81; 62/278; 62/323.1

[58] Field of Search ..... 62/81, 196.4, 238.6, 62/278, 323.1

[56] References Cited

U.S. PATENT DOCUMENTS

| | | | |
|---|---|---|---|
| 2,762,206 | 9/1956 | Ashley | 62/81 |
| 2,953,906 | 9/1960 | Quick | 62/81 |
| 2,976,698 | 3/1961 | Muffly | 62/160 |
| 3,213,637 | 10/1965 | Halls | 62/81 X |
| 3,367,131 | 2/1968 | Foessl | 62/238 |
| 3,869,874 | 3/1975 | Ditzler | 62/278 |
| 4,178,769 | 12/1979 | Johnsen | 62/196.4 X |
| 4,602,485 | 7/1986 | Fujimoto et al. | 62/174 |
| 4,646,539 | 3/1987 | Taylor | 62/278 |
| 4,660,384 | 4/1987 | Pallanch | 62/81 |
| 4,694,662 | 9/1987 | Adams | 62/509 |
| 4,696,168 | 9/1987 | Woods et al. | 62/200 |
| 4,706,468 | 11/1987 | Howland et al. | 62/278 X |

*Primary Examiner*—William E. Tapolcai
*Attorney, Agent, or Firm*—D. R. Lackey

[57] ABSTRACT

A refrigeration system, and method of operating same, in which an economizer heat exchanger, normally used in conjunction with an intermediate port of a refrigerant compressor to cool the main refrigerant flow from a receiver to an evaporator to enhance the refrigerant cooling cycle, is caused to function as an evaporator during a hot gas heating cycle. The economizer heat exchanger is caused to function as an evaporator by adding heat thereto during a heating cycle, and by establishing an alternate liquid line, effective during a heating cycle, which includes the economizer heat exchanger. When the compressor is driven by an internal combustion engine, engine coolant may be used to add the necessary heat to the economizer heat exchanger during a heating cycle.

24 Claims, 4 Drawing Sheets

METHOD AND APPARATUS FOR OPERATING A REFRIGERATION SYSTEM

TECHNICAL FIELD

The invention relates to methods and apparatus for operating a refrigeration system which maintains a temperature set point by heating and cooling cycles, and more specifically to methods and apparatus for enhancing the heating and defrost cycles of such systems.

BACKGROUND ART

The cooling cycle of a refrigeration system has been enhanced by diverting a portion of the main refrigerant stream flowing to an evaporator, expanding the diverted portion, and using the expanded refrigerant to cool the main refrigerant flow in a heat exchanger, which will be referred to as an economizer heat exchanger. The expanded refrigerant is returned to the compressor. It is an object of the present invention to utilize the economizer heat exchanger to enhance heating and/or defrost cycles, as well as the cooling cycle.

DISCLOSURE OF THE INVENTION

Briefly, the present invention relates to methods and apparatus for operating a refrigeration system which maintains a temperature set point by heating and cooling cycles, including a refrigerant circuit having a compressor with an intermediate pressure port, as well as suction and discharge ports. An economizer heat exchanger is used to enhance the cooling cycle, as in the prior art, having a first flow path through which the main refrigerant stream flows from a refrigerant receiver to an evaporator, and a second flow path through which a portion of the main refrigerant stream is diverted via an economizer heat exchanger expansion valve. The expanded refrigerant returns to the compressor via the intermediate pressure port.

A third flow path is provided in the economizer heat exchanger, which is in heat exchange relation with the second flow path. The first flow path is not utilized during heating and defrosting cycles, in preferred embodiments of the invention. The third flow path controllably receives a heated fluid from a source outside the refrigerant circuit, during such heating and defrost cycles of the refrigeration system, such as heat from liquid coolant used to cool an internal combustion engine which drives the refrigerant compressor.

During heating and defrost cycles hot compressor discharge gas is directed in a path which heats the evaporator, and which returns the refrigerant to the compressor via the second flow path of the economizer heat exchanger. The economizer heat exchanger functions as an evaporator during heating and defrosting cycles. The economizer heat exchanger may supply refrigerant only to the intermediate pressure port of the compressor during heating and defrosting cycles. Or, since the economizer heat exchanger is the only source of refrigerant to the compressor during heating and defrost cycles, an economizer by-pass valve may be used, controlled to be effective only during such heating and defrosting cycles, to divert some of the suction gas to the suction port of the compressor.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
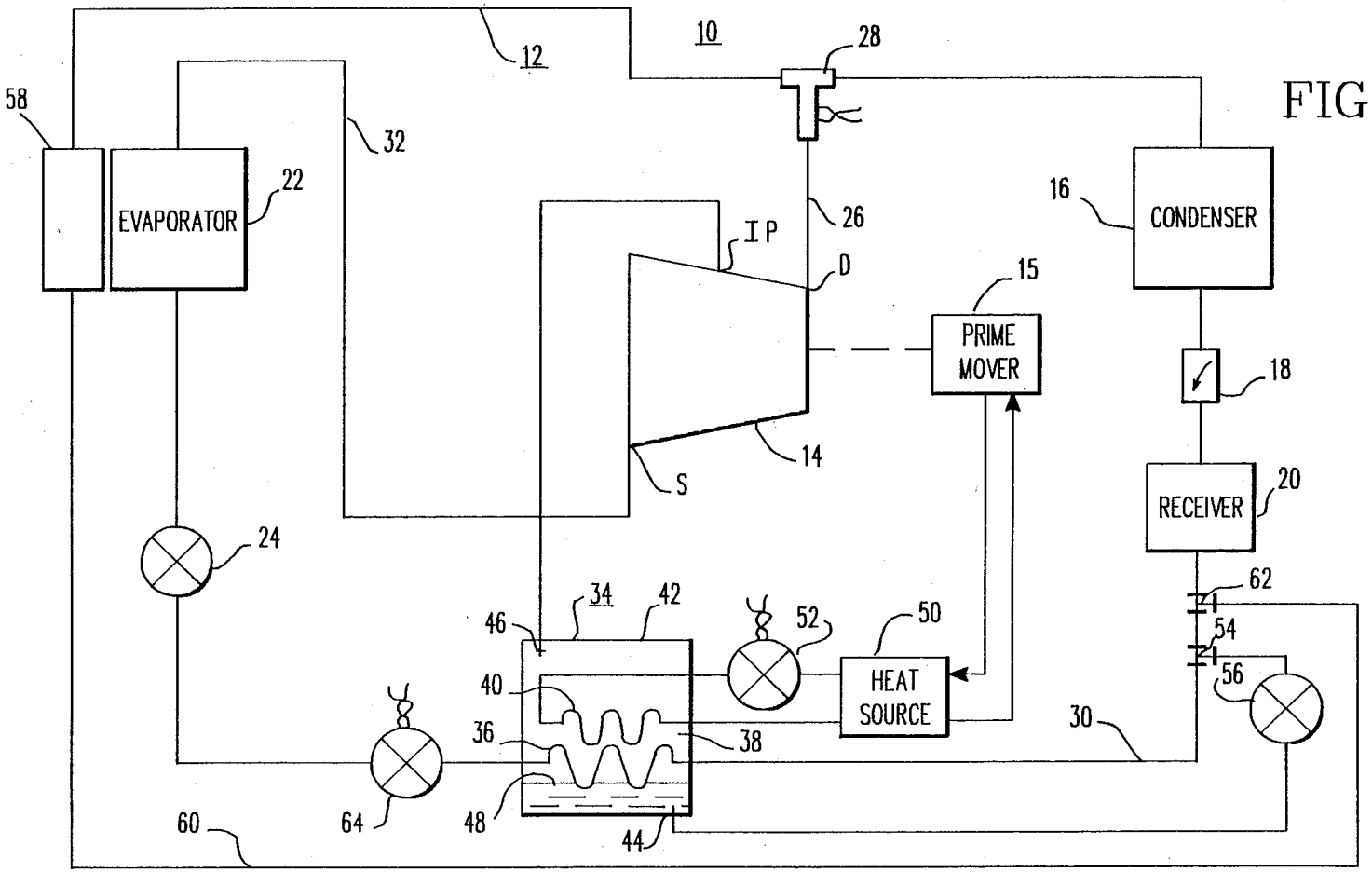
FIG. 1 illustrates a refrigeration system constructed according to a first embodiment of the invention in which the evaporator is heated indirectly during heating and cooling cycles.

Referring now to the drawings, and to FIG. 1 in particular, there is shown a refrigeration system 10 constructed according to a first embodiment of the invention. Refrigeration system 10, for example, may be a transport refrigeration system suitable for conditioning the air in a cargo space of a truck, trailer, or container. In general, refrigeration system 10 is of the type which maintains a temperature set point of a served space by heating and cooling cycles, both of which utilize the hot gas discharged from the discharge port of a refrigerant compressor. Defrosting of the evaporator section of such a refrigeration system may also be accomplished by using the hot gas compressor discharge.

More specifically, refrigeration system 10 includes a refrigerant circuit 12 comprising a compressor 14 driven by a prime mover 15, a condenser 16, a check valve 18, a receiver 20, an evaporator 22, and an expansion valve 24 for evaporator 22. Compressor 14 is of the type having a suction port S, an intermediate pressure port IP, and a discharge port D. A hot gas compressor discharge line 26 connects the discharge port D of compressor 14, to condenser 16 via a three-way valve 28, or its equivalent in two separate coordinated valves. A liquid line 30 interconnects receiver 20 and evaporator expansion valve 24, and a suction line 32 interconnects evaporator 22 and the suction port S of compressor 14.

A heat exchanger 34, which will be referred to as an economizer heat exchanger, has first, second and third flow paths 36, 38, and 40, respectively. The first flow path 36 is connected in the liquid line 30. The second flow path 38, which is defined by a shell 42 disposed about the first and third flow paths, 36 and 40, respectively, includes an inlet 44 and an outlet 46. Although liquid carry-over is not a problem with the disclosed arrangements, outlet 46 may be disposed such that should shell 42 contain any liquid refrigerant 48, only gaseous refrigerant will exit shell 42 via outlet 46. The third flow path 40 is connected to a controllable source 50 of heat, with the control, for example, being in the form of a solenoid controlled valve 52. The heat source 50 is outside refrigerant circuit 12, and is preferably a fluid which is heated by operation of the compressor prime mover 15. For example, prime mover 15 may be an internal combustion engine, such as a Diesel engine, and the heat source 50 may be liquid radiator coolant, or exhaust gas.

A small portion of the refrigerant in liquid line 30 is diverted from the main refrigerant stream at a tee 54 located between receiver 20 and economizer heat exchanger 34. The diverted refrigerant is expanded in an expansion valve 56 and the expanded refrigerant is introduced into the second flow path 38. The expanded refrigerant is in heat exchange relation with the first flow path 36, to cool refrigerant in the first flow path 36 during a cooling cycle of refrigeration system 10, to enhance the cooling cycle. Since gaseous refrigerant in the second flow path is at a higher pressure than refrigerant entering suction port S of compressor 14 from suction line 32 and the evaporator 22, outlet 46 is connected to the intermediate pressure port IP, placing less load on compressor 14.

When heat is required by a served space to maintain the temperature set point, and also when heat is required in order to defrost evaporator 22, three-way valve 28 is operated to divert the hot gas in hot gas line 26 to perform an evaporator heating function. In the embodiment of FIG. 1, evaporator 22 is heated by means 58 disposed in heat exchange relation with evaporator 22, such as by a separate set of tubes in the evaporator tube bundle.

Refrigerant leaving evaporator heating means 58, which is functioning as a condenser, is returned to compressor 14 via a second or alternate path or line 60 and the second flow path 38 of economizer heat exchanger 34. Since line 60 functions as a liquid line from the condensing function provided by the evaporator heating means 58, it will be referred to as an alternate liquid line. Alternate liquid line 60, for example, may enter a tee 62 between tee 54 and receiver 20. A solenoid valve 64 in liquid line 30 is closed during heating and defrosting cycles, to ensure that the refrigerant returns to compressor 14 via the economizer expansion valve 56 and the second flow path 38 of economizer heat exchanger 34. Also, during heating and defrosting cycles, solenoid valve 52 is opened to allow hot fluid from heat source 50 to circulate through the third flow path 40, adding heat to refrigerant in the second flow path 38, to enhance the heating and defrosting cycles. Thus, during heating and defrosting cycles, the economizer heat exchanger 34 functions as an evaporator, adding heat from a source 50 outside refrigerant circuit 12 to the refrigerant, to get more heat into the heating and defrosting functions. The heat added to refrigerant in the second flow path 38 by heat source 50 vaporizes any liquid refrigerant 48 that may have accumulated in the second flow path 38, with outlet 46 only allowing vaporized refrigerant to be drawn into the intermediate pressure port IP of compressor 14. The economizer heat exchanger 34 also eliminates the need for a high pressure liquid/suction gas heat exchanger used in the prior art to improve system capacity by transferring some of the heat from the high temperature liquid line to the low temperature suction gas. The present invention improves system capacity in both the cooling and the heating modes, including defrost.

Figure 2:
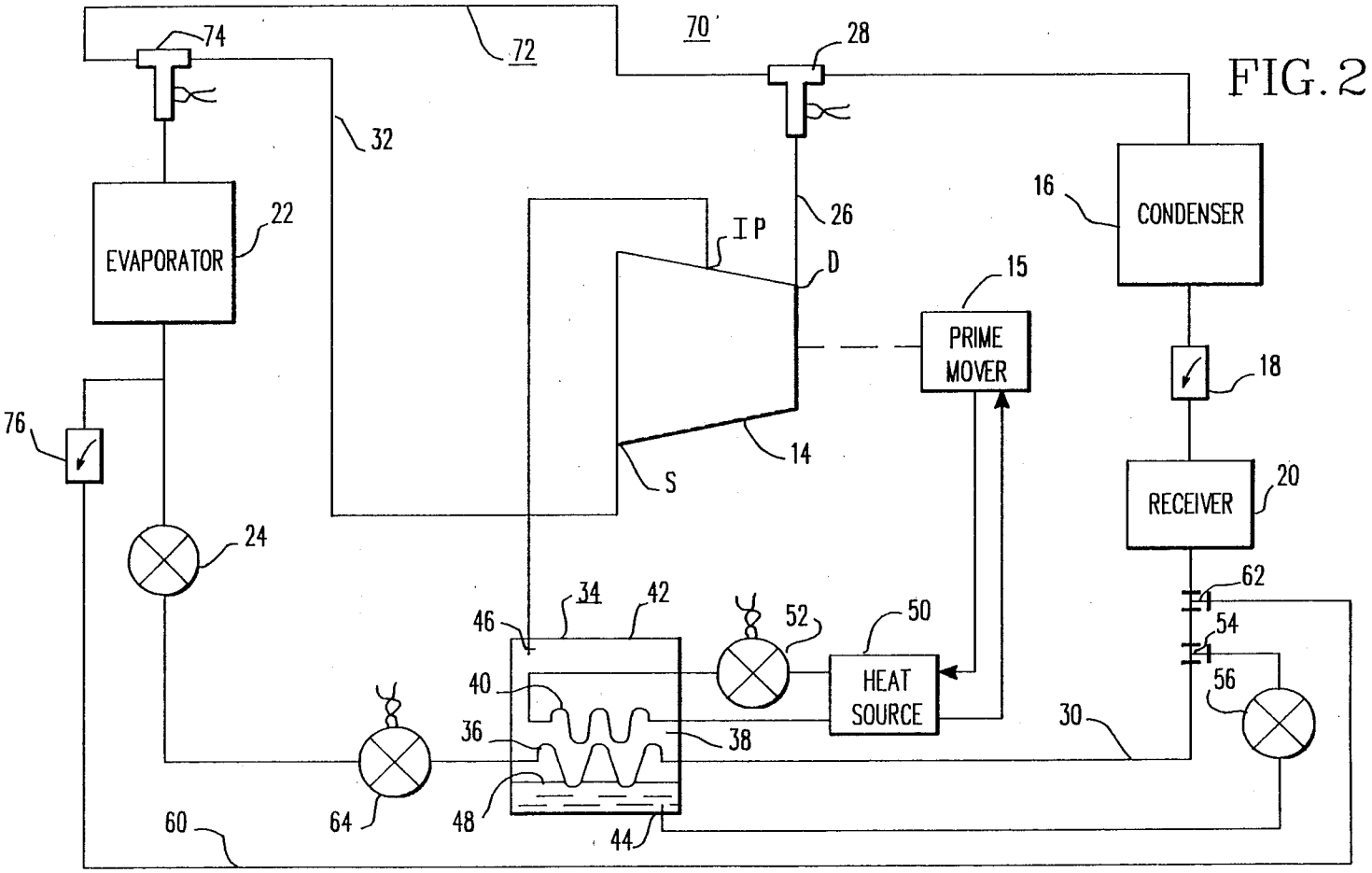
FIG. 2 illustrates a modification of the refrigeration system shown in FIG. 1 in which the evaporator is heated directly during heating and cooling cycles.
Figure 3:
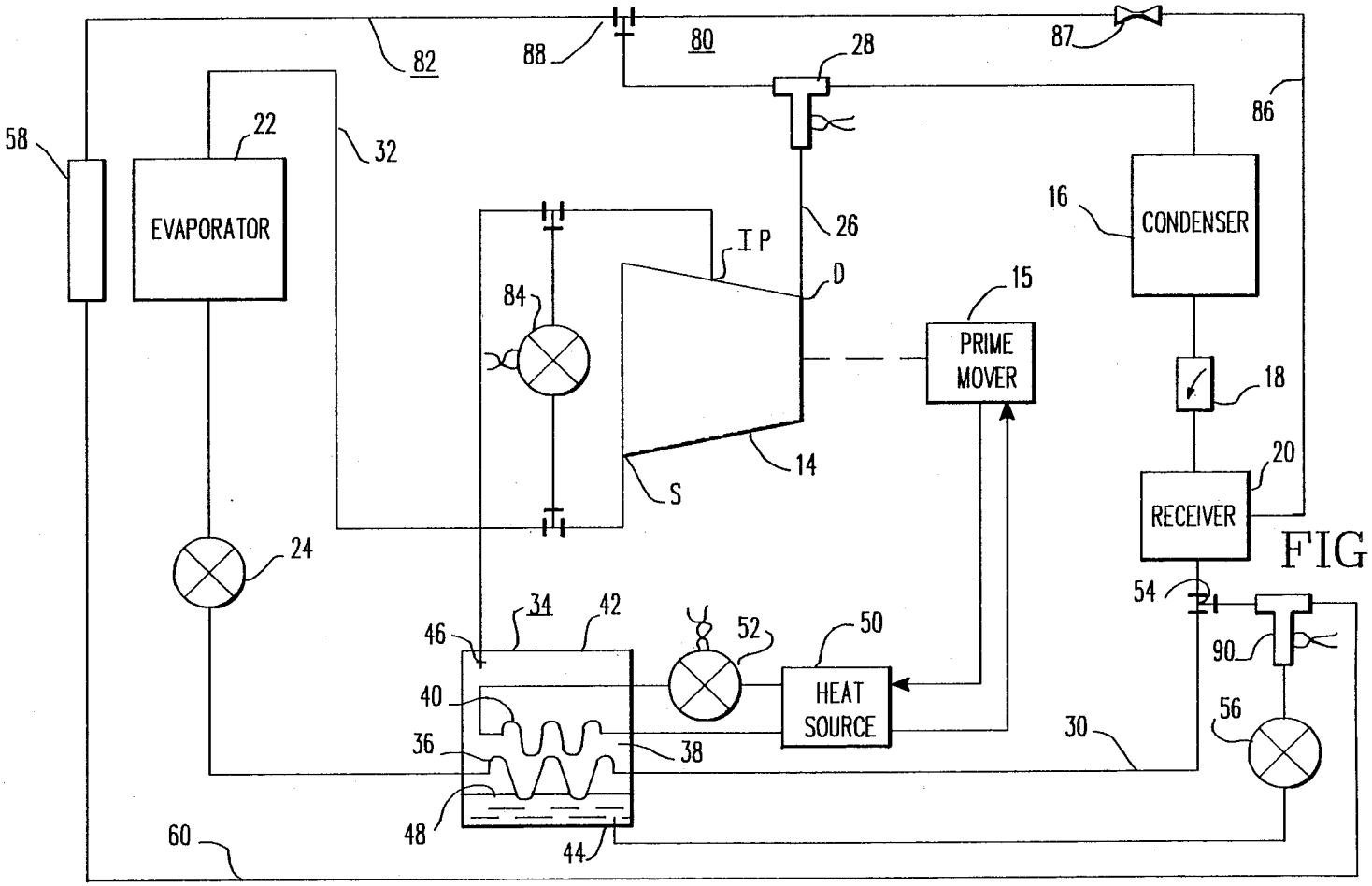
FIG. 3 illustrates a refrigeration system constructed according to another embodiment of the invention, in which the evaporator is heated indirectly, a by-pass valve, active during heating and defrost cycles, introduces refrigerant into both the suction and intermediate pressure ports of the compressor, and the receiver is pressurized during heating and cooling cycles to force more refrigerant into these cycles.
Figure 4:
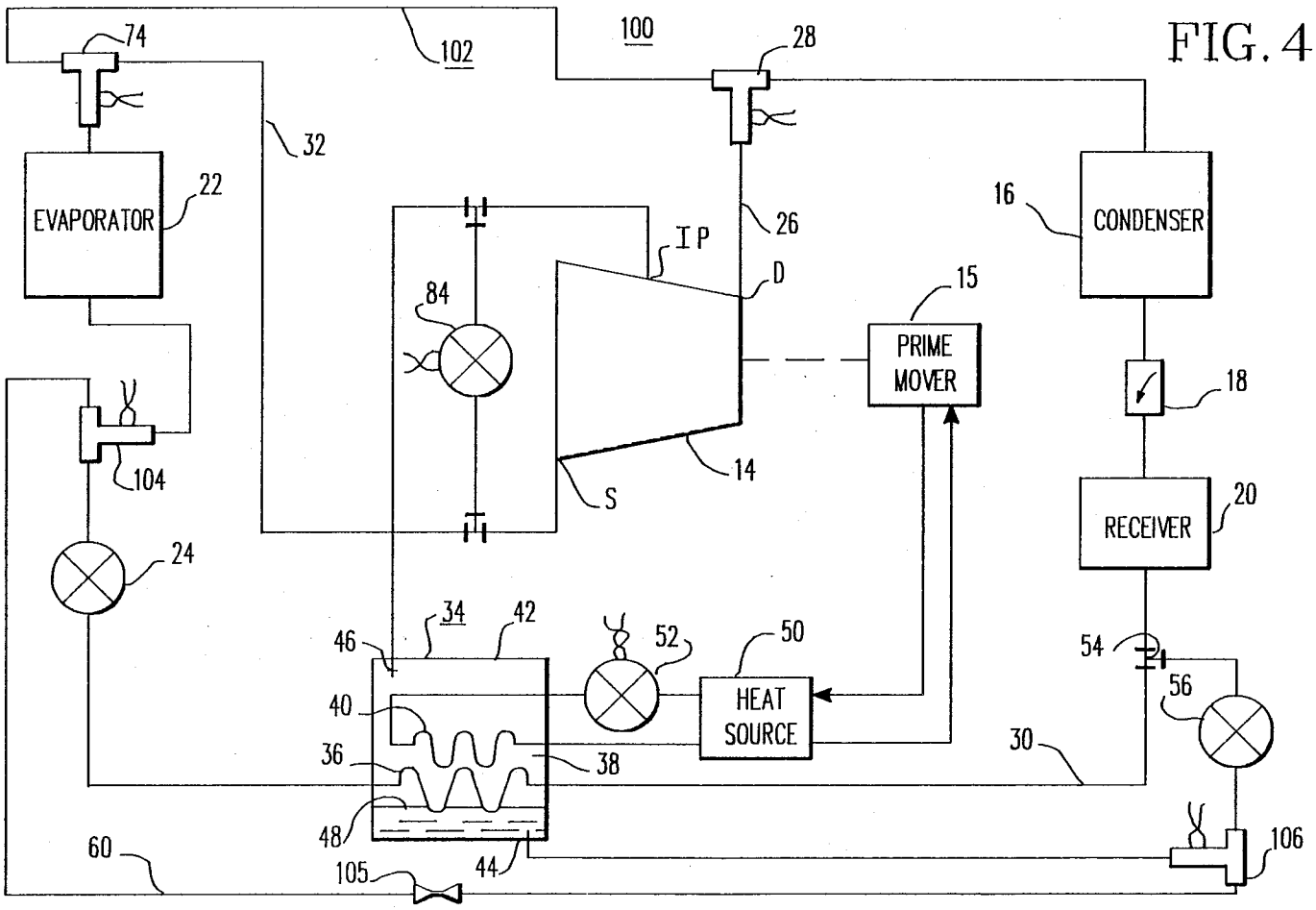
FIG. 4 illustrates a refrigeration system constructed according to still another embodiment of the invention.

FIGS. 2, 3 and 4 illustrate desirable embodiments of the invention, with like reference numerals being used to indicate components of system 10 which may be used in the embodiments. FIG. 2 illustrates a refrigeration system 70 which eliminates the need for the separate evaporator heater 58 of the FIG. 1 embodiment. System 70 includes a refrigeration circuit 72 which differs from refrigeration circuit 12 by reversing the flow of refrigerant through evaporator 22 during heating and defrosting cycles, in effect using the evaporator as a condenser. The refrigeration circuit 72 requires the addition of a three-way valve 74 and a check valve 76. Three-way valve 74 is connected such that in a position used during a cooling cycle it connects the outlet of evaporator 22 to suction line 32, and in a position used during heating and defrost cycles it connects the hot gas line 26 to evaporator 22 via three-way valve 28. Check valve 76 is connected in the alternate liquid line 60, to prevent refrigerant from entering liquid line 60 from tee 62 during a cooling cycle. In the operation of refrigeration system 70, it functions the same as system 10 during a cooling cycle. During a heating or defrost cycle, hot gas is directed into evaporator 22 from compressor 14 and hot gas line 26 via three-way valves 28 and 74. Check valve 76 directs refrigerant back to compressor 14 from evaporator 22 via alternate liquid line 60 and the second flow path of economizer heat exchanger 34. Similar to the FIG. 1 embodiment, solenoid valve 64 is closed during heating and defrost cycles; and solenoid valve 52 is open to add heat to the refrigerant returning to compressor 14 via the second flow path 38 of the economizer heat exchanger 34.

FIG. 3 illustrates a refrigeration system 80 having a refrigeration circuit 82 which in some respects is similar to refrigeration circuit 12 of the FIG. 1 embodiment, as a separate evaporator heater 58 is used. FIG. 3 also introduces a desirable embodiment of the invention in the form of an economizer by-pass valve 84 connected between the suction and intermediate pressure ports S and IP, respectively, of compressor 14. By-pass valve 84 is controlled to open during heating and defrost cycles. During heating and defrost cycles the normal flow to suction port S is closed. If the compressor pumps only through the limited economizer port, the pumping capability may be limited. The economizer by-pass valve 84 precludes any limitation on pumping capability.

FIG. 3 also introduces an aspect of the invention in which a small bleed flow is made possible to accommodate transient conditions which may occur during heating and defrosting. This function is provided by interconnecting the hot compressor gas with the receiver via a bleed line 86, shown with a restriction 87 to indicate limited flow. Any heat exchange which may occur in the evaporator due to bleed flow is inconsequential.

FIG. 3 also adds a three-way valve 90 in the alternate suction line 60, connected and controlled such that during a cooling cycle some main stream refrigerant in the liquid line 30 is allowed to flow through the economizer expansion valve 56 and into the second flow path 38 of heat exchanger 34, while blocking flow into the alternate liquid line 60. During a heating or defrost cycle, valve 90 effectively eliminates tee 54, returning all refrigerant from evaporator heater 58 to compressor 14 through the economizer expansion valve 56 and the second flow path 38 of heat exchanger 34. The expansion valve 56 must be selected to accommodate both the normal or cooling mode and the heat/defrost mode, but the FIG. 3 arrangement has the advantage that three-way valve 90 will only be required to handle liquid refrigerant.

FIG. 4 illustrates a refrigeration system 100 having a refrigeration circuit 102 which is similar in some respects to both FIGS. 2 and 3, illustrating direct heating of evaporator 22 via a three-way valve 74, as in the FIG. 2 embodiment, and also showing the economizer by-pass valve 84 of the FIG. 3 embodiment. The refrigeration circuit 102 of FIG. 4 also illustrates that a three-way valve 104 may be used to connect the liquid line 30 to evaporator 22 while in a cooling cycle, and to connect evaporator 22 to the alternate liquid line 60 during heating and defrost cycles. Thus, three-way valve 104 eliminates check valve 76 of the FIG. 2 embodiment. Also, since three-way valve 104 blocks the liquid line 30 during heating and defrost cycles, the pressurizing bleed line 86 of the FIG. 3 embodiment is not required.

The FIG. 4 embodiment also features a three-way valve 106 which in a first position allows the diversion of a portion of the main liquid stream from liquid line 30 via tee 54 during a cooling cycle, and in a second position returns refrigerant to the compressor 14 via the alternate liquid line 60 and the second flow path 38 of heat exchanger 34, by-passing the economizer expansion valve 56. In the prior embodiments, the alternate liquid 60 included the economizer expansion valve. In this embodiment, line 60 must be small, indicated by restriction 105. Three-way valve 106 is required to handle both liquid and gas, but expansion valve 56 need be selected only for the cooling mode.

In summary, there has been disclosed a new and improved method of operating a refrigeration system of the type having an economizer heat exchanger having a first flow path in the liquid line for improving cooling cycles, and new and improved refrigerant circuits for performing the method. The invention provides a dual use for the economizer heat exchanger, i.e., use during a cooling cycle, and also use during heating and defrost cycles, by the method steps of:

(1) providing a second flow path through the heat exchanger which is used in both cooling and heating cycles, (2) using refrigerant from the hot gas compressor discharge line to heat the evaporator during a heating cycle, (3) providing an alternate liquid line which is effective, during a heating cycle to return refrigerant to the intermediate port of the compressor via the second flow path of the heat exchanger, and (4) adding heat to the heat exchanger during a heating cycle to cause the heat exchanger to function as an evaporator to enhance the heating cycle. The step of adding heat to the heat exchanger is accomplished by providing a third flow path through the heat exchanger.

We claim:

1. In a method of operating a refrigeration system which maintains a temperature set point by heating and cooling cycles, including a refrigerant circuit which includes a compressor having a suction port, an intermediate pressure port, and a discharge port; a hot gas compressor discharge line; a condenser; a receiver; a liquid line; an evaporator; a suction line; an expansion valve for the evaporator in the liquid line; a heat exchanger having a first flow path in the liquid line between the receiver and the evaporator expansion valve; and an expansion valve for the heat exchanger disposed to reduce pressure on a portion of the refrigerant flowing from the receiver during a cooling cycle to provide a gas for cooling refrigerant in the liquid line, the improvement comprising the steps of:

providing a second flow path through the heat exchanger which is used in both cooling and heating cycles, using refrigerant from the hot gas compressor discharge line to heat the evaporator during a heating cycle, providing an alternate liquid line which is effective during a heating cycle to return refrigerant to the intermediate port of the compressor via the second flow path of the heat exchanger, and adding heat to the heat exchanger during a heating cycle to cause the heat exchanger to function as an evaporator, to enhance the heating cycle.

2. The method of claim 1 including the step of blocking the liquid line between the heat exchanger and the evaporator during a heating cycle.

3. The method of claim 1 wherein the step of using refrigerant in the hot gas compressor discharge line to heat the evaporator during a heating cycle includes the steps of:

providing heat exchange means in heat exchange relation with the evaporator, and directing refrigerant in the heat gas compressor discharge line through said heat exchange means during a heating cycle.

4. The method of claim 1 wherein the step of returning refrigerant in the alternate liquid line to the intermediate port of the compressor during a heating cycle includes the step of providing a path which includes the heat exchanger expansion valve.

5. The method of claim 1 wherein the step of returning refrigerant in the alternate liquid line to the intermediate port of the compressor during a heating cycle includes the step of providing a path which bypasses the heat exchanger expansion valve.

6. The method of claim 1 wherein the step of using refrigerant in the hot gas compressor discharge line to heat the evaporator includes the steps of:

blocking the liquid line between the heat exchanger and the evaporator expansion valve, and directing refrigerant in the hot gas compressor discharge line through the evaporator in a direction opposite to refrigerant flow therethrough during a cooling cycle, and wherein the step of returning refrigerant in the alternate liquid line to the intermediate port of the compressor includes the step of providing a path which includes the heat exchanger expansion valve.

7. The method of claim 1 wherein the step of using refrigerant from the hot gas compressor discharge line to heat the evaporator includes the steps of:

blocking the liquid line between the heat exchanger and the evaporator expansion valve, and directing refrigerant from the hot gas compressor discharge line through the evaporator in a direction opposite to refrigerant flow therethrough during a cooling cycle, and wherein the step of returning refrigerant in the alternate liquid line to the intermediate port of the compressor includes the step of providing a path which bypasses the heat exchanger expansion valve.

8. The method of claim 1 wherein the step of returning refrigerant in the alternate liquid line to the intermediate port of the compressor also returns a portion of the refrigerant to the suction port.

9. A refrigeration system which maintains a temperature set point by heating and cooling cycles, including a refrigerant circuit which includes a compressor having a suction port, an intermediate pressure port, and a discharge port; a hot gas compressor discharge line; a condenser; a receiver; a liquid line; an evaporator; a suction line; an expansion valve for the evaporator in the liquid line; a heat exchanger having a first flow path in the liquid line between the receiver and the evaporator expansion valve; and an expansion valve for the heat exchanger disposed to reduce pressure on a portion of the refrigerant flowing from the receiver during a cooling cycle to provide a gas for cooling the refrigerant in the liquid line, the improvement comprising:

means providing a second flow path through the heat exchanger which is used in both cooling and heating cycles, means heating the evaporator during a heating cycle with refrigerant from the hot gas compressor discharge line, means providing an alternate liquid line during a heating cycle for returning refrigerant to the intermediate port of the compressor via the second flow path of the heat exchanger, and means adding heat to the heat exchanger during a heating cycle to cause the heat exchanger to function as an evaporator, to enhance the heating cycle.

10. The refrigeration system of claim 9 including means blocking the liquid line between the heat exchanger and the evaporator during a heating cycle.

11. The refrigeration system of claim 9 wherein the means heating the evaporator with refrigerant from the hot gas compressor discharge line includes:

heat exchange means in heat exchange relation with the evaporator, and means directing refrigerant from the hot gas compressor discharge line through said heat exchange means during a heating cycle.

12. The refrigeration system of claim 9 wherein the alternate liquid line provides a return flow path which includes the heat exchanger expansion valve.

13. The refrigeration system of claim 9 wherein the alternate liquid line provides a return flow path which bypasses the heat exchanger expansion valve.

14. The refrigeration system of claim 9 wherein the means heating the evaporator with refrigerant from the hot gas compressor discharge line includes:

means blocking the liquid line between the heat exchanger and the evaporator expansion valve, means directing refrigerant from the hot gas compressor discharge line through the evaporator in a direction opposite to refrigerant flow therethrough during a cooling cycle, and wherein the alternate liquid line provides a flow path which includes the heat exchanger expansion valve.

15. The refrigeration system of claim 9 wherein the means heating the evaporator with refrigerant from the hot gas compressor discharge line includes:

means blocking the liquid line between the heat exchanger and the evaporator expansion valve, means directing refrigerant from the hot gas compressor discharge line through the evaporator in a direction opposite to refrigerant flow therethrough during a cooling cycle, and wherein the alternate liquid line provides a flow path which bypasses the heat exchanger expansion valve.

16. The refrigeration system of claim 9 including means which returns a portion of the refrigerant to the suction port of the compressor during a heating cycle.

17. The refrigeration system of claim 9 including an internal combustion engine for driving the compressor, and a liquid coolant for said internal combustion engine, and wherein the means adding heat to the heat exchanger during a heating cycle directs said liquid coolant in heat exchange relation with the heat exchanger.

18. The refrigeration system of claim 9 including a bleed line interconnecting the hot gas compressor discharge line and the receiver during a heating cycle to accommodate transient conditions.

19. The refrigeration system of claim 9 wherein the means heating the evaporator with refrigerant from the hot gas compressor discharge line includes first and second three-way valve means in the hot gas compressor discharge line which directs refrigerant to the evaporator, and a check valve in the alternate liquid line.

20. The refrigeration system of claim 9 wherein the means heating the evaporator with refrigerant from the hot gas compressor discharge line includes first and second three-way valve means in the hot gas compressor discharge line which directs refrigerant to the evaporator, and three-way valve means in the alternate liquid line.

21. The refrigeration system of claim 9 wherein the means heating the evaporator with refrigerant from the hot gas compressor discharge line includes first and second three-way valve means in the hot compressor gas discharge line which directs refrigerant to the evaporator, and third and fourth three-way valve means in the alternate liquid line, with the fourth three-way valve means by-passing the heat exchanger expansion valve during a heating cycle.

22. The refrigeration system of claim 9 wherein the means heating the evaporator with refrigerant in the hot gas compressor discharge line includes heat exchange means disposed in heat exchange relation with the evaporator, and three-way valve means which directs refrigerant from the hot gas compressor discharge line through said heat exchange means during a heating cycle.

23. The refrigeration system of claim 22 wherein the alternate liquid line includes three-way valve means which directs refrigerant to the heat exchanger via the heat exchanger expansion valve while blocking refrigerant flow from the receiver to the heat exchanger expansion valve, and a bleed line interconnecting the hot gas compressor discharge line and the receiver via the three-way valve means during the heating cycle.

24. The refrigeration system of claim 9 including a third flow path through the heat exchanger, an internal combustion engine for driving the compressor, and a liquid coolant for said internal combustion engine, and wherein the means adding heat to the heat exchanger during a heating cycle directs said liquid coolant through the third flow path of the heat exchanger.

* * * * *